US005231068A

United States Patent [19]

Miyamoto et al.

[11] Patent Number: 5,231,068

[45] Date of Patent: Jul. 27, 1993

[54] THERMOSENSITIVE RECORDING MATERIAL

[75] Inventors: Shuji Miyamoto, Numazu; Motoo Tasaka; Akie Murofushi, both of Susuno, all of Japan

[73] Assignee: Ricoh Company, Ltd., Tokyo, Japan

[21] Appl. No.: 795,741

[22] Filed: Nov. 21, 1991

[30] Foreign Application Priority Data

Nov. 21, 1990 [JP] Japan ..... 2-314336

[51] Int. Cl.[5] ..... B41M 5/124

[52] U.S. Cl. ..... 503/207; 427/152; 503/200; 503/209; 503/214; 503/226

[58] Field of Search ..... 503/200, 214, 226, 207, 503/209; 427/152

[56] References Cited

U.S. PATENT DOCUMENTS 4,904,635 2/1990 Tamagawa et al. ..... 503/200
4,929,590 5/1990 Maruta et al. ..... 503/200

FOREIGN PATENT DOCUMENTS 4131256 3/1992 Fed. Rep. of Germany .

*Primary Examiner*—Pamela R. Schwartz
*Attorney, Agent, or Firm*—Oblon, Spivak, McClelland, Maier & Neustadt

[57] ABSTRACT

A thermosensitive recording material is composed of a support, an undercoat layer formed on the support, which is essentially composed of spherical-void plastic particles having an average particle diameter of 2 to 20 μm and a voidage of 80% or more, and a thermosensitive coloring layer formed on the undercoat layer, which contains a leuco dye and a color developer capable of inducing color formation in the leuco dye upon application of heat thereto.

22 Claims, No Drawings

THERMOSENSITIVE RECORDING MATERIAL

BACKGROUND OF THE INVENTION

1. Field of the Invention

This invention relates to a thermosensitive recording material, and more particularly to a thermosensitive recording material comprising a support, an undercoat layer formed on the support, comprising spherical-void plastic particles having an average particle diameter of 2 to 20 μm and a voidage of 80% or more, and a thermosensitive coloring layer formed on the undercoat layer, comprising a leuco dye and a color developer capable of inducing color formation in the leuco dye upon application of heat thereto.

2. Discussion of Background

Recently, various information recording materials of a non-environmental-pollution type, capable of nursing resources and economizing energy, have been developed and put to practical use for the purpose of dealing with a great variety of information. In particular, thermosensitive recording materials have been widely utilized in various fields, for instance, for use with terminal printers for computers and calculators, recorders for medical measurement instruments, low- and high-speed facsimile apparatus, automatic ticket vending apparatus, copying machines, and label printing machines for the POS system, because of the following advantages thereof:

(1) images can be readily recorded on a thermosensitive recording material by simply applying heat thereto without employing a complicated development process;

(2) a relatively simple and μmall-sized apparatus is available for preparing a thermosensitive recording material, handling of the recording material is easy, and the maintenance cost of the same is inexpensive; and (3) in the case where paper, which is not costly as compared with other materials, is used as a support, a thermosensitive recording material with a plain paper-like touch is obtainable.

In general, the thermosensitive recording material is prepared by applying a coating liquid for forming a thermosensitive coloring layer, which contains a coloring component for color formation by application of heat, to the surface of a sheet of plain paper or synthetic paper, or a plastic film, and then dried. Images are recorded on the thus prepared recording material with application of heat by a thermal pen or thermal head. Such thermosensitive recording materials are disclosed, for instance, in Japanese Patent Publications 43-4160 and 45-14039. These conventional recording materials, however, sluggishly respond to thermal energy, so that images with high density are not obtainable when high-speed recording is performed.

In order to overcome the above shortcomings, it has been proposed to incorporate the following compounds into the conventional thermosensitive recording materials: nitrogen-containing compounds such as acetamide, stearamide, m-nitroaniline and dinitrile phthalate (Japanese Laid-Open Patent Application 49-38424); acetoacetic anilide (Japanese Laid-Open Patent Application 52-106746); N,N-diphenylamine derivatives, benzamide derivatives and carbazole derivatives (Japanese Laid-Open Patent Application 53-11036); alkylated biphenyl and biphenyl alkane (Japanese Laid-Open Patent Application 53-39139); and p-hydroxy benzoate derivatives (Japanese Laid-Open Patent Application 56-144193).

However, satisfactory recording materials cannot be obtained by incorporating any of the above compounds.

Japanese Laid-Open Patent Application 56-164890 discloses that the thermal sensitivity of a thermosensitive recording material can be improved by using an amorphous leuco dye, which is obtained by converting the corresponding crystalline leuco dye to the amorphous leuco dye, and has a lower melting point than that of the corresponding crystalline leuco dye. Such amorphous leuco dyes, however, are highly reactive because of their activated surfaces, so that a coating liquid for forming a thermosensitive coloring layer containing such an amorphous leuco dye causes a so-called liquid fogging, or the thermosensitive recording material containing the same has the problem that the fogging of the background occurs, which reduces the whiteness of the background.

It is required that a thermosensitive recording material have an excellent dot reproduction property to obtain clear images with high density. In other words, it is required that a thermal head touch a thermosensitive coloring layer as closely and smoothly as possible, the thermal conduction from the thermal head to the thermosensitive coloring layer be performed as quickly as possible, and each dot be formed on a thermosensitive coloring layer in the shape faithful to the shape of each heating element of the thermal head. However, the thermal conductivity of the conventional thermosensitive recording materials is so low that only several percent of heat is conducted from the thermal head to the thermosensitive coloring layer.

Several proposals have been made for improving the surface smoothness of the thermosensitive coloring layer so that the thermal head smoothly touches the thermosensitive coloring layer. Japanese Patent Publication No. 52-20142 discloses a thermosensitive recording material comprising a thermosensitive coloring layer which is surface-treated to have a surface smoothness of 200 to 1000 sec. in terms of Bekk's smoothness. On the other hand, in Japanese Laid-Open Patent Application No. 54-115255, it is said that the thermosensitive coloring layer having the surface smoothness of 200 to 1000 sec. in terms of Bekk's smoothness is capable of performing image recording only with a thermal pulse of about 5 to 6 msec., so that it is necessary that the thermosensitive coloring layer be surface-treated to have a surface smoothness of 1100 sec. or more in terms of Bekk's smoothness for high-speed recording of 1 msec. or less. However, when the thermosensitive recording material comprising the thermosensitive coloring layer is subjected to the surface treatment to have the surface smoothness of 1100 sec. or more in terms of Bekk's smoothness, the fogging of the background is caused by the pressure applied during the surface treatment. Therefore, it is necessary that the base paper for the thermosensitive coloring layer be surface-treated beforehand to have a surface smoothness of 500 sec. or more, to prevent the fogging of the background. Japanese Laid-Open Patent Application No. 55-156086 discloses a thermosensitive recording material comprising a thermosensitive coloring layer with an optical surface smoothness (Ra) of 1.2 μm or less and a glossiness of 25% or less.

In the above-mentioned prior art, only calendering methods such as supercalendering, machine calendering and gloss calendering are conducted in an attempt to improve the smoothness of the thermosensitive coloring layer. The calendering is applied only to the base paper, to both the base paper and thermosensitive recording paper, or only to the thermosensitive recording paper. When the surface smoothness and the image density of the thermosensitive recording paper are improved by the above-mentioned calendering, both a sticking problem and a piling problem occur. The sticking problem is such a problem that a thermal head sticks or adheres to the thermosensitive coloring layer and a noise is generated when the thermal head is separated from the thermosensitive coloring layer, or the dot reproduction property of the thermosensitive recording material is caused to deteriorate. The piling problem is such a problem that the heat-fused materials from the thermosensitive coloring layer are piled on the thermal head and cause the deterioration of image density and dot reproduction property. Because of those sticking and piling problems, the surface smoothness of the thermosensitive coloring layer is restricted to a level at which the image density, the sticking and the piling of the heat-fused materials are appropriately balanced in the conventional image formation. However, even though the smoothness of the thermosensitive recording materials is set at any level, the thermosensitive recording material is not satisfactory for high-speed recording in terms of image density and image stability.

The calendering methods have another shortcoming that the fogging of the background is caused by the pressure applied thereto during the calendering process, so that a clear distinction between a printed portion and the background is not obtainable. For instance, the image density is not always improved when the thermosensitive recording material is caused to have a surface smoothness of 1000 sec. or more in terms of Bekk's smoothness as a result of the supercalendering. In some cases, when such a calendering is performed, the slight uneveness of the base paper with respect to the basis weight thereof is intensified so that the head-matching property of the thermosensitive recording material is caused to deteriorate and the image density decreases.

When the surface smoothness of the thermosensitive recording material is improved by the above-mentioned calendering applied to the base paper or to the thermosensitive paper, the thickness of the thermosensitive recording material is reduced as a whole and the densities of the thermosensitive coloring layer and the base paper are increased. When this takes places, the voidages of the thermosensitive coloring layer and the base paper which is in contact therewith are reduced. Although this results in a slight improvement of the thermal conductivity of the thermosensitive coloring layer, it prevents the heat-fused materials on the surface of the thermosensitive coloring layer from penetrating into the inside of the thermosensitive recording material through the thermosensitive coloring layer and the base paper thereof during the recording step. It is considered that the heat-fused materials remaining on the surface of the thermosensitive coloring layer cause both the sticking and piling problems.

As stated above, when it is attempted to improve the image density by surface-treating the thermosensitive coloring layer with the calendering, the calendering inevitably causes the sticking and piling problems, and the fogging of the background. Therefore, it is difficult to improve the image density and also to prevent the sticking and piling problems and the fogging of the background.

Japanese Patent Application No. 58-136492 discloses a thermosensitive recording material comprising a lightly coated layer having an optical surface smoothness (Rp Value) of 8 μm or less and a thickness of 40 μm to 75 μm. However, this thermosensitive recording material is not satisfactory in terms of thermal coloring sensitivity and dot reproduction property.

In order to prevent the fogging of the background and to enhance the dynamic coloring sensitivity of the recording material, several methods described below have been proposed. For instance, a material having a thermal conductivity of 0.04 Kcal/mh° C. or less is employed as a support as disclosed in Japanese Laid-Open Patent Application 55-164192; and a layer comprising minute void particles as the main component is formed on a support as disclosed in Japanese Laid-Open Patent Applications 59-5093 and 59-225987. However, these thermosensitive recording materials prepared in the above manners are not satisfactory because they have low flexibility, poor heat insulating properties, and low thermal head-matching property.

Japanese Laid-Open Patent Application 62-5886 discloses a thermosensitive recording material comprising an intermediate layer which contains non-expandable minute void particles made of a thermoplastic resin, having a diameter of 5 μm or less and Japanese Laid-Open Patent Application No. 1-113282, an undercoat layer containing spherical-void plastic particles having an average particle diameter ranging from 0.20 to 1.5 μm and a voidage of 40 to 90%. However, the use of such plastic spherical-void particles is not a decisive manner for preparing a thermosensitive recording material having high sensitivity.

SUMMARY OF THE INVENTION

It is therefore an object of the present invention to provide a thermosensitive recording material having high thermal coloring sensitivity and excellent dot reproduction property.

The object of the present invention can be attained by a thermosensitive recording material comprising (a) a support, (b) an undercoat layer formed on the support, comprising spherical-void plastic particles having an average particle diameter of 2 to 20 μm and a voidage of 80% or more, and (c) a thermosensitive coloring layer formed on the undercoat layer, comprising a leuco dye and a color developer capable of inducing color formation in the leuco dye upon application of heat thereto.

DETAILED DESCRIPTION OF THE PREFERRED EMBODIMENTS

The spherical-void plastic particles employed in an undercoat layer of a thermosensitive recording material according to the present invention are expanded minute void particles comprising a shell made of a thermoplastic polymer and a gas such as air or the like inside the above-mentioned shell.

It is preferable that the average particle diameter of the spherical-void plastic particles range from 2 to 20 μm, more preferably from 3 to 10 μm. The spherical-void plastic particles having the above preferable average particle diameter can be produced at low cost because the above voidage is easily obtained. Moreover, the obtained thermosensitive recording material having the above-mentioned spherical-void plastic particles has an excellent head-matching property and sufficient dot reproduction and thermal coloring sensitivity for use in practice, because the surface of the undercoat layer of the thermosensitive recording material remains smooth after an undercoat layer coating liquid is coated on a support and dried. Therefore, it is preferable that not only the average particle diameter of the spherical-void plastic particles be in the above preferable range, but also the particle distribution thereof be little scattered and the distribution peaks thereof be in uniform.

Moreover, it is preferable that the spherical-void plastic particles to be employed in the undercoat layer for use in the present invention have a voidage of 80% or more, more preferably 90% or more. Since the spherical-void plastic particles having the above preferable voidage have an excellent heat insulating property, the thermal energy transmitted from the thermal head cannot be emitted to the outside of the thermosensitive recording material through the support thereof. Thus the prepared thermosensitive recording material has the excellent thermal coloring sensitivity.

The voidage mentioned above is directed to the ratio of the inner diameter to the outer diameter of the spherical-void plastic particle, and expressed by the following equation:

$$\text{Voidage (\%)} = \frac{\text{Inner Dia. of Void Particle}}{\text{Outer Dia. of Void Particle}} \times 100$$

Examples of the spherical-void plastic particles employed in the thermosensitive recording material of the present invention are polystyrene, polyvinyl chloride, polyvinylidene chloride, polyvinyl acetate, polyacrylate, polyacrylonitrile, polybutadiene, and copolymers of the above. As the gas contained inside the shell, air, and propane and butane gases can be employed.

The previously mentioned undercoat layer can be formed on the support by dispersing the above-mentioned spherical-void plastic particles in water with a conventionally known binder such as a water-soluble polymer or an aqueous polymer emulsion, coating the above prepared dispersion on the surface of the support, and drying it.

In the above, the amount of the spherical-void plastic particles is at least 1 g, preferably 2 to 15 g per 1 $m^2$ of the support.

The binder employed in the undercoat layer of the thermosensitive recording material according to the present invention can be used in any amount as far as the undercoat layer can be firmly fixed to the support. Conventionally, it is employed in an amount of 2 to 50 wt.% of the total weight of the spherical-void plastic particles and the binder.

The above binder is selected from the conventionally known water-soluble polymer and aqueous polymer emulsion.

Specific examples of the water-soluble polymer are as follows: polyvinyl alcohol; starch and starch derivatives; cellulose derivatives such as methoxycellulose, hydroxyethylcellulose, carboxymethylcellulose, methylcellulose, and ethylcellulose; sodium polyacrylate; polyvinyl pyrrolidone; acrylamide-acrylic acid ester copolymer; acrylamide-acrylic acid ester-methacrylic acid terpolymer; alkali salts of styrene-maleic anhydride copolymer; alkali salts of isobutylene-maleic anhydride copolymer; polyacrylamide; sodium alginate; gelatin; and casein.

Examples of the aqueous polymer emulsion are latexes such as styrene-butadiene copolymer and styrene butadiene-acrylic acid derivative copolymer, and emulsions such as polyvinyl acetate, polyvinyl acetate-acrylic acid copolymer, styrene-acrylic acid ester copolymer, acrylic acid ester resin, and polyurethane.

Moreover, when necessary, the auxiliary additive components which are used in the conventional thermosensitive recording materials, such as a filler, thermofusible material, and surface active agent can be employed with the previously mentioned spherical-void plastic particles and binder.

Examples of the filler for use in the present invention include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea formaldehyde resin, styrene-methacrylic acid copolymer and polystyrene resin.

Examples of the thermofusible material are as follows: higher fatty acids and esters, amides, and metal salts thereof; and other thermofusible organic compounds with a melting point ranging from 50° to 200° C., such as various kinds of waxes, condensates of aromatic carboxylic acids and amines, phenyl benzoate, higher straight-chain glycol, dialkyl 3,4-epoxy-hexahydrophthalate, and higher ketone.

In the thermosensitive recording material of the present invention, the undercoat layer can further comprise an inorganic thickening agent such as a swelling fluorine-containing mica mineral, a montmorilonite mineral, and sepiolite.

The swelling fluorine-containing mica mineral contained in the undercoat layer coating liquid of the thermosensitive recording material according to the present invention is colloidal hydrous magnesium lithium silicate or colloidal hydrous magnesium sodium silicate. Specific examples of the above swelling fluorine-containing mica mineral are as follows:

Na-tetrasilicicmica $[NaMg_{2.5}(Si_4O_{10})F_2]$
Na-taeniolite $[NaMg_2Li(Si_4O_{10})F_2]$
Li-taeniolite $[LiMg_2Li(Si_4O_{10})F_2]$
Na-hectorite $[Na_{\frac{1}{3}}Mg_{2\frac{2}{3}}Li_{\frac{1}{3}}(Si_4O_{10})F_2]$
Li-hectorite $[Li_{\frac{1}{3}}Mg_{2\frac{2}{3}}Li_{\frac{1}{3}}(Si_4O_{10})F_2]$ Such a swelling fluorine-containing mica mineral is characterized by absorbing water molecules between crystals thereof and swelling up. At the most advanced swelling property of the swelling fluorine-containing mica mineral, the crystals thereof are cleft and transformed into ultrafine flakes which form a stable sol in water. A thixotropic fluidity property of the swelling fluorine-containing mica mineral can be observed when a shearing stress is applied thereto.

The montmorilonite mineral that can be employed in the undercoat layer of the thermosensitive recording material according to the present invention is a cation-partly-replaced colloidal hydrous aluminum silicate. There are various kinds of cation-partly-replaced colloidal hydrous aluminum silicates, such as a silicate in which the Al in $Al_2O_3.4SiO_2.H_2O.nH_2O$ is partly replaced by Mg, and a silicate in which the Si in the same structural formula is partly replaced by Al. Specific examples of the cation-partly-replaced colloidal hydrous aluminum silicate are Mg-bentonite (Al is partly replaced by Mg), Ca-bentonite (Al is partly replaced by Ca), and H-bentonite (All the adsorption ions are replaced by hydrogen). Natural bentonite is abundant in the above-mentioned montmorilonite minerals.

Such a montmorilonite mineral has a structural viscosity: when it absorbs water, its crystal lattice swells and its volume increases 16 or more times as large as its original volume. Moreover, a thixotropic fluidity property can be observed in the montmorilonite mineral when a shearing stress is applied thereto.

Sepiolite can be contained in the undercoat layer coating liquid used for the thermosensitive recording material of the present invention. It is represented by the structural formula of $(OH_2)_4(OH)_4Mg_8Si_{12}O_{30}\cdot 6\text{-}8H_2O$. Its crystal structure resembles the structure of alternately laid talc bricks. Unlike a conventional lamellar clay such as the montmorilonite, a swelling phenomenon cannot be observed in sepiolite because it has a three-dimensional chain structure in its crystals. Furthermore, the voids between the chain-like structure have a large surface area, and cause high viscosity and thixotropy in the sepiolite when a slurry thereof is made.

The spherical-void plastic particles contained in the undercoat layer coating liquid tend to float and aggregate because the specific gravity thereof is small. Thus the prepared undercoat layer easily peels from the support of the thermosensitive recording material in a short time of period, and the surface of the above undercoat layer tends to be rough. However, the inorganic thickening agent such as the previously mentioned swelling fluorine-containing mica mineral, montmorilonite mineral, or sepiolite has an effect of preventing the spherical-void plastic particles from floating and aggregating upside of the undercoat layer coating liquid and of making the surface of the prepared undercoat layer smooth. Therefore, the thermosensitive recording material prepared by coating the undercoat layer coating liquid containing the above-mentioned inorganic thickening agent has an excellent sensitivity.

It is preferable that the amount ratio of the inorganic thickening agent to 1 part by weight of the spherical-void plastic particles be 0.5 to 0.005 parts by weight, more preferably, 0.1 to 0.01 parts by weight because the inorganic thickening agent in the above preferable amount ratio has satisfactory heat insulating and coating liquid improvement effects.

It is also preferable that the thermosensitive recording material of the present invention have a thermal conductivity of 0.70 W/m° K. or less and an optical surface smoothness (λ) of 0.85 μm or less. In the thermosensitive recording material having the above preferable thermal conductivity, the thermal energy conducted from the thermal head cannot be diffused to the outside of the thermosensitive coloring layer, so that the thermal energy is kept in the thermosensitive coloring layer. Furthermore, the thermosensitive recording material having the above preferable optical surface smoothness has an excellent head-matching property, so that it efficiently absorbs the thermal energy from the thermal head. Therefore, the thermosensitive recording material having the above preferable thermal conductivity and optical surface smoothness has the excellent thermal coloring sensitivity.

In the present invention, the optical surface smoothness (Rp Value) indicates an optically measured value of the average depth of depressions in the surface of paper when the paper is placed in pressure contact with the surface of a prism. The principle of the above method is discussed in "Methods for Measuring Printed Smoothness of Paper Focused on the Optical Contact Method" (by Shinpei Inamoto, Research Review of the Printing Bureau, Ministry of Finance, Vol.29, No.9, September 1977, pp. 615–622). As a device for measuring the Rp Value, Micro TOPOGRAPH (made by Toyo Seiki Seisaku-sho, Ltd.) can be employed.

The previously mentioned optical surface smoothness (Rp Value) is the value obtained 100 msec. after a pressure of 6.0 kg/cm$^2$ has been applied to the paper by the prism.

Furthermore, the thermal conductivity is measured by a QTM-type thermal conductivity tester using the same principle as that of an improved Probe Method, which is based on a heat radiation method employed in the Japanese Industrial Standards (JIS) R2618.

This method for the measurement of thermal conductivity is based on the principle that if the thermal conductivity of a reference plate and that of a test sample sheet are the same, the thermal conductivity of the test sample sheet when measured by superimposing the test sample sheet on the reference plate is equal to the thermal conductivity of the test sample when measured alone.

More specifically, several kinds of homogeneous reference plates, each having a different thermal conductivity, are prepared. The thermal conductivity of each plate is measured and the obtained value is referred to as λ. Then a test sample sheet and a probe are successively placed on the plate and the thermal conductivity is measured by the probe. The obtained value here is referred to as λ'. deviation $(\lambda'-\lambda)/\lambda$, as ordinate. The value of λ measured with an interpolation method when the deviation is 0 is the thermal conductivity of the test sample sheet.

As the device for the measurement of thermal conductivity, Shotherm QTM-B Rapid Thermal Conductivity Tester (made by Showa Denko K.K.) and Kemtherm QTM-D3 (made by Kyoto Electronics Manufacturing Co., Ltd.) can be employed.

In the present invention, as the leuco dyes for use in the thermosensitive coloring layer, which can be used alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds, and indolinophtalide-type leuco compounds are preferably employed. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran, 3-N-methyl-N-isoamylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-N-ethyl-N-tetrahydrofurfurylamino-6-methyl-7-anilinofluoran,
3-N-ethyl-N-(2-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4',5'-benzofluoran,
3-N-methyl-N-isopropyl-6-methyl-7-anilinofluoran,
3-N-ethyl-N-isoamyl-6-methyl-7-anilinofluoran, and
3-diethylamino-6-methyl-7-(2',4'-dimethylanilino)fluoran, As the color developers for use in the thermosensitive coloring layer in the present invention, various electron acceptors which work upon the above-mentioned leuco dyes to induce color formation and oxidizing agents are preferably employed.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis[6-tert-butyl-2-methyl)phenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis[4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoate,
2-hydroxy-1-naphthoate,
1-hydroxy-2-naphthoate,
metal salts such as zinc, aluminum, calcium of hydroxynaphthoate,
bis-(4-hydroxyphenyl)methyl acetate,
bis-(4-hydroxyphenyl)benzyl acetate,
1,3-bis-(4-hydroxycumyl)benzene,
1,4-bis-(4-hydroxycumyl)benzene,
2,4'-diphenolsulfone,
2,2'-diallyl-4,4'-diphenolsulfone,
3,4-dihydroxyphenyl-4'-methylphenylsulfone,
α,α-bis(4-hydroxyphenyl)-α-methyltoluene,
antipyrine complex of zinc thiocyanate,
tetrabromobisphenol A, and
tetrabromobisphenol S.

In the thermosensitive coloring layer of the thermosensitive recording material according to the present invention, the conventional binder can be employed with the above-mentioned leuco dye and color developer. Specific examples of the binder are the same as those employed in the undercoat layer. Moreover, when necessary, the auxiliary additive components which are used in the conventional thermosensitive recording materials, such as a filler, thermofusible material, and surface active agent can be employed with the previously mentioned leuco dye and color developer. Specific examples of the filler and thermofusible material are the same as those employed in the undercoat layer.

In the present invention, when necessary, an intermediate layer comprising a filler, a binder, a thermofusible material and the like can be provided between the undercoat layer and the thermosensitive coloring layer of the thermosensitive recording material. Specific examples of the filler, binder, and thermofusible material are the same as those employed in the undercoat layer and the thermosensitive coloring layer.

Furthermore, in the present invention, it is possible to provide a protective layer on the thermosensitive coloring layer to improve the head-matching property and image preservability. The above-mentioned filler, binder, surface active agent and thermofusible material can be contained in the above protective layer.

The thermosensitive recording material according to the present invention can be prepared by successively coating the previously mentioned undercoat layer coating liquid and thermosensitive coloring layer coating liquid on a support made of paper, synthetic paper, or plastic film, drying them, and when necessary, operating a surface treatment with the calendering. The thus obtained thermosensitive recording material can be utilized in a variety of fields related to the thermosensitive recording.

Other features of this invention will become apparent in the course of the following description of exemplary embodiments, which are given for illustration of the invention and are not intended to be limiting thereof.

EXAMPLE 1

Preparation of Undercoat Layer

A liquid A serving as an undercoat layer coating liquid was prepared by stirring a mixture with the following formulation:

| [Liquid A] | parts by weight |
|---|---|
| Dispersion of spherical-void plastic particles of vinylidene chloride - acrylonitrile copolymer (solid component: 32%) (voidage: 92%) (average particle diameter: 5 μm) | 30 |
| Latex of styrene - butadiene copolymer (solid component: 47.5%) | 10 |
| Water | 60 |

The thus prepared undercoat layer coating liquid was coated on a sheet of commercially available high quality paper having a basis weight of 52 g/m$^2$ in a deposition amount of 5 g/m$^2$ on a dry basis, and the coated liquid was dried. Thus, an undercoat layer was formed on the sheet serving as a support.

Preparation of Thermosensitive Coloring Layer

A liquid B and a liquid C were separately prepared by pulverizing and grinding the respective mixtures with the following formulations in a sand grinder in such a manner that the solid components in each mixture have an average particle diameter of 2.5 μm or below:

| | parts by weight |
|---|---|
| [Liquid B] | |
| 3-(N-methyl-3-N-cyclohexyl)amino-6-methyl-7-anilinofluoran | 20 |
| 10% aqueous solution of polyvinyl alcohol | 20 |
| Water | 60 |
| [Liquid C] | |
| 1,5-bis(4-hydroxyphenylthio)-3-oxapentane | 10 |
| Calcium carbonate | 15 |
| 10% aqueous solution of polyvinyl alcohol | 25 |
| Water | 50 |

One part by weight of [liquid B] and 10 parts by weight of [liquid C] were mixed and stirred, so that a thermosensitive coloring layer coating liquid was prepared This thermosensitive coloring layer coating liquid was coated on the surface of the above-prepared undercoat layer in a deposition of 5 g/m$^2$ on a dry basis, and then dried, so that a thermosensitive coloring layer was formed. The thermosensitive coloring layer was then subjected to supercalendering to have a surface smoothness of 600 to 700 sec. in terms of Bekk's smoothness, whereby a thermosensitive recording material No. 1 according to the present invention was obtained.

EXAMPLE 2

The procedure for Example 1 was repeated except that the dispersion of the spherical-void plastic particles with the average particle diameter of 5 μm of vinylidene chloride-acrylonitrile copolymer having a voidage of 92% in the formulation of [liquid A] employed in Example 1 was replaced by a dispersion of spherical-void plastic particles with an average diameter of 15 μm of vinylidene chloride-acrylonitrile copolymer having a voidage of 93% and solid component of 30%, whereby a thermosensitive recording material No. 2 according to the present invention was obtained.

EXAMPLE 3

The procedure for Example 1 was repeated except that the dispersion of the spherical-void plastic particles with the average particle diameter of 5 μm of vinylidene chloride-acrylonitrile copolymer having a voidage of 92% in the formulation of [liquid A] employed in Example 1 was replaced by a dispersion of spherical-void plastic particles with an average diameter of 9 μm of vinylidene chloride-acrylonitrile copolymer having a voidage of 93% and solid component of 30%, whereby a thermosensitive recording material No. 3 according to the present invention was obtained.

EXAMPLE 4

The procedure for Example 1 was repeated except that the dispersion of the spherical-void plastic particles with the average particle diameter of 5 μm of vinylidene chloride-acrylonitrile copolymer having a voidage of 92% in the formulation of [liquid A] employed in Example 1 was replaced by a dispersion of spherical-void plastic particles with an average diameter of 2.5 μm of vinylidene chloride-acrylonitrile copolymer having a voidage of 84% and solid component of 30%, whereby a thermosensitive recording material No. 4 according to the present invention was obtained.

EXAMPLE 5

The procedure for Example 1 was repeated except that the dispersion of the spherical-void plastic particles with the average particle diameter of 5 μm of vinylidene chloride-acrylonitrile copolymer having a voidage of 92% in the formulation of [liquid A] employed in Example 1 was replaced by a dispersion of spherical-void plastic particles with an average diameter of 18 μm of vinylidene chloride-acrylonitrile copolymer having a voidage of 89% and solid component of 32%, whereby a thermosensitive recording material No. 5 according to the present invention was obtained.

EXAMPLE 6

Preparation of Undercoat Layer

A liquid D serving as an undercoat layer coating liquid was prepared by stirring and dispersing a mixture with the following formulation:

| [Liquid D] | parts by weight |
|---|---|
| Dispersion of spherical-void plastic particles of vinylidene chloride - acrylonitrile copolymer (solid component: 31%) (voidage: 95%) (average particle diameter: 7 μm) | 30 |
| Dispersion of Na-tetrasilicicmica (Trademark "NaTSS", made by Topy Industries, Ltd.) (solid component: 5%) | 6 |
| Latex of styrene - butadiene copolymer (solid component: 47%) | 10 |
| Water | 54 |

The thus prepared undercoat layer coating liquid was coated on a sheet of commercially available high quality paper having a basis weight of 52 g/m$^2$ in a deposition amount of 6 g/m$^2$ on a dry basis, and the coated liquid was dried. Thus, an undercoat layer was formed on the sheet serving as a support.

Preparation of Thermosensitive Coloring Layer

A liquid E and a liquid F were separately prepared by pulverizing and grinding the respective mixtures with the following formulations in a sand grinder in such a manner that the solid components in each mixture have an average particle diameter of 2 μm or below:

| | parts by weight |
|---|---|
| [Liquid E] | |
| 3-(N-methyl-3-N-cyclohexyl)amino-6-methyl-7-anilinofluoran | 20 |
| 10% aqueous solution of polyvinyl alcohol | 20 |
| Water | 60 |
| [Liquid F] | |
| Benzyl p-hydroxybenzoate | 10 |
| 10% aqueous solution of polyvinyl alcohol | 25 |
| Calcium carbonate | 15 |
| Water | 50 |

One part by weight of [liquid E] and 8 parts by weight of [liquid F] were mixed and stirred, so that a thermosensitive coloring layer coating liquid was prepared.

This thermosensitive coloring layer coating liquid was coated on the surface of the above-prepared undercoat layer in a deposition of 7 g/m$^2$ on a dry basis, and then dried, so that a thermosensitive coloring layer was formed. The thermosensitive coloring layer was then subjected to supercalendering to have a surface smoothness of 500 to 600 sec. in terms of Bekk's smoothness, whereby a thermosensitive recording material No. 6 according to the present invention was obtained.

EXAMPLE 7

The procedure for Example 6 was repeated except that six parts by weight of the dispersion of Na-tetrasilicicmica in [liquid D] serving as an undercoat layer coating liquid employed in Example 6 were replaced by six parts by weight of Na-hectorite dispersion (Trademark "Laponite RD", made by Laporte Industry Co., Ltd.) having a solid component of 5%, whereby a thermosensitive recording material No. 7 according to the present invention was obtained.

EXAMPLE 8

The procedure for Example 6 was repeated except that six parts by weight of the dispersion of Na-tetrasilicicmica in [liquid D] serving as an undercoat layer coating liquid employed in Example 6 were replaced by six parts by weight of a dispersion of sodium montmorilonite (Trademark "Kunipia-F", made by Kunimine Industries Co., Ltd.) having a solid component of 5%, whereby a thermosensitive recording material No. 8 according to the present invention was obtained.

EXAMPLE 9

The procedure for Example 6 was repeated except that six parts by weight of the dispersion of Na-tetrasilicicmica in [liquid D] serving as an undercoat layer coating liquid employed in Example 6 were replaced by six parts by weight of a dispersion of purified bentonite (Trademark "Fine Gel", made by Murakami Nendokogyo Co., Ltd.) having a solid component of 5%, whereby a thermosensitive recording material No. 9 according to the present invention was obtained.

EXAMPLE 10

The procedure for Example 6 was repeated except that six parts by weight of the dispersion of Na-tetrasilicicmica in [liquid D] serving as an undercoat layer coating liquid employed in Example 6 were replaced by six parts by weight of a dispersion of sepiolite (Trademark "Aid-plus", made by Mizusawa Industrial Chemicals, Ltd.) having a solid component of 5%, whereby a thermosensitive recording material No. 10 according to the present invention was obtained.

EXAMPLE 11

The procedure for Example 6 was repeated except that six parts by weight of the dispersion of Na-tetrasilicicmica in [liquid D] serving as an undercoat layer coating liquid employed in Example 6 were replaced by six parts by weight of a dispersion of sepiolite (Trademark "Milcon", made by Showa Mining Co., Ltd.) having a solid component of 5%, whereby a thermosensitive recording material No. 11 according to the present invention was obtained.

EXAMPLE 12

Preparation of Undercoat Layer

A liquid G serving as an undercoat layer coating liquid was prepared by stirring and dispersing a mixture with the following formulation:

| [Liquid G] | parts by weight |
|---|---|
| Dispersion of spherical-void plastic particles of vinylidene chloride - acrylonitrile copolymer (solid component: 31%) (voidage: 95%) (average particle diameter: 7 μm) | 30 |
| Latex of styrene - butadiene copolymer (solid component: 47%) | 10 |
| Water | 60 |

The thus prepared undercoat layer coating liquid was coated on a sheet of commercially available high quality paper having a basis weight of 52 g/m$^2$ in a deposition amount of 6 g/m$^2$ on a dry basis, and the coated liquid was dried. Thus, an undercoat layer was formed on the sheet serving as a support.

Preparation of Thermosensitive Coloring Layer

The procedure for preparing the thermosensitive coloring layer in Example 6 was repeated, so that a thermosensitive coloring layer was formed on the undercoat layer.

Furthermore, the prepared material was subjected to supercalendering to have a surface smoothness of 1000 to 1500 sec. in terms of Bekk's smoothness, whereby a thermosensitive recording material No. 12 according to the present invention was obtained.

The thermal conductivity of the thermosensitive recording material was 0.60 W/m° K. and the optical surface smoothness thereof was 0.79 μm.

COMPARATIVE EXAMPLE 1

The procedure for Example 1 was repeated except that the dispersion of spherical-void plastic particles with the average particle diameter of 5 μm of vinylidene chloride-acrylonitrile copolymer having a voidage of 92% in the formulation of [liquid A] employed in Example 1 was replaced by a dispersion of spherical-void plastic particles with an average diameter of 0.4 μm, a voidage of 75% and solid component of 37.5% (Trademark "OP-62", made by Rohm and Haas, Japan K.K.), whereby a comparative thermosensitive recording material No. 1 was obtained.

COMPARATIVE EXAMPLE 2

The procedure for Example 1 was repeated except that the dispersion of spherical-void plastic particles in the formulation of [liquid A] employed in Example 1 was replaced by a dispersion of spherical-solid (not void) plastic particles (Trademark "SPMM-HS", made by Mitsui Toatsu Chemicals Inc.) having a solid component of 47%, whereby a comparative thermosensitive recording material No. 2 was obtained.

The above prepared thermosensitive recording materials in Examples 1 to 5 and comparative thermosensitive recording materials were subjected to dynamic thermal coloring sensitivity test and dot reproduction test. The method of each test is as follows:

(i) Dynamic Thermal Coloring Sensitivity Test

Each recording material was loaded in a thermal printer having a thin film head (made by Matsushita Electronic Components Co., Ltd.), and images were printed under the following conditions:

| | |
|---|---|
| Head power: | 0.45 W/dot |
| Recording time for one line: | 20 msec/line |
| Line density: | 8 × 3.85 dots/mm |
| Pulse width: | 0.3 msec, 0.4 msec, 0.5 msec, and 0.6 msec. |

The density of the printed image was measured by a Mcbeth densitometer "RD-914".

(ii) Dot Reproduction Test

Dot reproduction property of each recording material was evaluated by visually inspecting the images obtained by the above-mentioned dynamic thermal coloring sensitivity test.

The results of both tests are shown in Table 1.

TABLE 1

| Ex. No. | Dynamic Thermal Coloring Sensitivity: Back-ground | 0.3 ms | 0.4 ms | 0.5 ms | 0.6 ms | Dot Reproduction (*) |
|---|---|---|---|---|---|---|
| Ex. 1 | 0.07 | 1.10 | 1.28 | 1.38 | 1.40 | 5 |
| 2 | 0.07 | 1.03 | 1.22 | 1.33 | 1.34 | 4 |
| 3 | 0.07 | 1.07 | 1.25 | 1.35 | 1.38 | 5 |
| 4 | 0.07 | 1.00 | 1.21 | 1.30 | 1.32 | 4 |
| 5 | 0.07 | 1.02 | 1.22 | 1.31 | 1.33 | 4 |
| Comp. Ex. 1 | 0.07 | 0.90 | 1.20 | 1.28 | 1.30 | 3 |
| 2 | 0.07 | 0.79 | 1.18 | 1.27 | 1.31 | 3 |

(*)
5: Excellent
4: Good
3: Normal
2: Poor
1: Very poor

The above data indicate that the thermosensitive recording materials of the present invention have high thermal coloring sensitivity and excellent dot reproduction property.

What is claimed is:

1. A thermosensitive recording material comprising: (a) a support, (b) an undercoat layer formed on said support, comprising spherical-void plastic particles having an average particle diameter of 2 to 20 μm and a voidage of 80% or more, and (c) a thermosensitive coloring layer formed on said undercoat layer, comprising a leuco dye and a color developer capable of inducing color formation in said leuco dye upon application of heat thereto.

2. The thermosensitive recording material as claimed in claim 1, wherein said undercoat layer further comprises an inorganic thickening agent.

3. The thermosensitive recording material as claimed in claim 2, wherein the amount of said inorganic thickening agent contained in said undercoat layer is in the range of 0.5 to 0.005 parts by weight per 1 part by weight of said spherical-void plastic particles.

4. The thermosensitive recording material as claimed in claim 3, wherein the amount of said inorganic thickening agent contained in said undercoat layer is in the range of 0.1 to 0.01 parts by weight per 1 part by weight of said spherical-void plastic particles.

5. The thermosensitive recording material as claimed in claim 1, having a thermal conductivity of 0.70 W/m° K.. or less and an optical surface smoothness of 0.85 μm or less.

6. The thermosensitive recording material as claimed in claim 1, wherein said spherical-void plastic particles contained in said undercoat layer have an average particle diameter of 3 to 10 μm.

7. The thermosensitive recording material as claimed in claim 1, wherein said spherical-void plastic particles contained in said undercoat layer have a voidage of 90% or more.

8. The thermosensitive recording material as claimed in claim 1, wherein said spherical-void plastic particles contained in said undercoat layer are selected from the group consisting of polystyrene, polyvinyl chloride, polyvinylidene chloride, polyvinyl acetate, polyacrylate, polyacrylonitrile, polybutadiene, and copolymers of said polymers.

9. The thermosensitive recording material as claimed in claim 1, wherein the amount of said spherical-void plastic particles in said undercoat layer is at least 1 g per 1 $m^2$ of said support.

10. The thermosensitive recording material as claimed in claim 9, wherein the amount of said spherical-void plastic particles in said undercoat layer is in the range of 2 to 15 g per 1 $m^2$ of said support.

11. The thermosensitive recording material as claimed in claim 1, wherein said undercoat layer further comprises a binder.

12. The thermosensitive recording material as claimed in claim 11, wherein the amount of said binder is 2 to 50 wt. % of the total weight of said spherical-void plastic particles and said binder.

13. The thermosensitive recording material as claimed in claim 11, wherein said binder is a water-soluble polymer.

14. The thermosensitive recording material as claimed in claim 13, wherein said water-soluble polymer is selected from the group consisting of polyvinyl alcohol, starches, methoxycellulose, hydroxyethylcellulose, carboxymethylcellulose, methylcellulose, ethylcellulose, sodium polyacrylate, polyvinyl pyrrolidone, acrylamide-acrylic acid ester copolymer, acrylamide-acrylic acid ester-methacrylic acid terpolymer, alkali salts of styrene-maleic anhydride copolymer, alkali salts of isobutylene-maleic anhydride copolymer, polyacrylamide, sodium alginate, gelatin and casein.

15. The thermosensitive recording material as claimed in claim 11, where said binder is formed from an aqueous polymer emulsion.

16. The thermosensitive recording material as claimed in claim 15, wherein said aqueous polymer emulsion is selected from the group consisting of latexes of styrene-butadiene copolymer and styrene-butadiene-acrylic acid copolymer, and emulsions of polyvinyl acetate, polyvinyl acetate-acrylic acid copolymer, styrene-acrylic acid ester copolymer, acrylic acid ester resin and polyurethane.

17. The thermosensitive recording material as claimed in claim 11, wherein said undercoat layer further comprises at least one additional component selected from the group consisting of a filler, a thermofusible material and a surface active agent.

18. The thermosensitive recording material as claimed in claim 1, further comprising an intermediate layer between said undercoat layer and said thermosensitive coloring layer, said intermediate layer comprising a filler, a binder and a thermofusible material.

19. The thermosensitive recording material as claimed in claim 1, further comprising a protective layer formed on said thermosensitive coloring layer, said protective layer comprising a filler, a binder, a surface active agent and a thermofusible material.

20. A thermosensitive recording material comprising:

(a) a support, (b) an undercoat layer formed on said support, comprising spherical-void plastic particles having an average particle diameter of 2 to 20 μm and a void-age of 80% or more, and (c) a thermosensitive coloring layer formed on said undercoat layer, comprising a leuco dye and a color developer capable of inducing color formation in said leuco dye upon application of heat thereto, wherein said undercoat layer further comprises an inorganic thickening agent contained in said undercoat layer and is selected from the group consisting of swelling fluorine-containing mica mineral, montmorilonite mineral, and sepiolite.

21. The thermosensitive recording material as claimed in claim 20, wherein said swelling fluorine-containing mica mineral contained in said undercoat layer is selected from the group consisting of Na-tetrasilicic-mica, Na-taeniolite, Li-taeniolite, Na-hectorite, and Li-hectorite.

22. The thermosensitive recording material as claimed in claim 20, wherein said montmorillonite mineral contained in said undercoat layer is selected from the group consisting of Mg-bentonite, Ca-bentonite, and H-bentonite.

* * * * *

UNITED STATES PATENT AND TRADEMARK OFFICE

CERTIFICATE OF CORRECTION

PATENT NO. : 5,231,068

DATED : July 27, 1993

INVENTOR(S) : Shuji Miyamoto, et al

It is certified that error appears in the above-indentified patent and that said Letters Patent is hereby corrected as shown below:

Column 1, Line 34, "and μmall-sized" should read --and small-sized--

Column 3, Line 46, "this takes places" should read --this takes place--

Column 8, Line 26, "to as λ'. deviation (λ' - λ/λ, as ordinate." should read --to as λ'. The thermal conductivity (λ) is plotted as abscissa and the deviation (λ' - λ/λ, as ordinate.--

Column 10, Line 17, "1,5-bis(4-hydroxyphenylthio)-3-oxapentane" should read --1,5-bis-(hydroxyphenylthio)-3-oxapentane--

Column 11, Line 65, "pared" should read --pared.--

Column 16, Line 48, "K.. or less" should read --K or less--

Column 17, Line 28, "where said binder" should read --wherein said binder--

Signed and Sealed this

Eighth Day of August, 1995

*Attest:*

*Attesting Officer*

BRUCE LEHMAN

*Commissioner of Patents and Trademarks*